United States Patent [19]

Patrichi

[11] 4,150,266

[45] Apr. 17, 1979

[54] MINIATURE PYROTECHNIC SQUIB SWITCH, SINGLE POLE, NORMALLY OPEN

[75] Inventor: Mihai D. Patrichi, Los Angeles, Calif.

[73] Assignee: Networks Electronic Corp., Chatsworth, Calif.

[21] Appl. No.: 762,873

[22] Filed: Jan. 27, 1977

[51] Int. Cl.[2] ..... H01H 39/00

[52] U.S. Cl. ..... 200/61.08; 200/82 R; 89/1 B; 102/203; 337/413

[58] Field of Search ..... 30/DIG. 4; 60/632, 633, 60/636; 89/1 B; 102/28 EB, 70.2 R; 200/61.08, 82 R, 83 R; 337/401, 402, 403, 406, 409, 413, 416

[56] References Cited

U.S. PATENT DOCUMENTS

| | | | |
|---|---|---|---|
| 2,712,575 | 7/1955 | Kiel | 337/409 |
| 2,721,240 | 10/1955 | Filbert, Jr. | 200/83 R |
| 2,721,913 | 10/1955 | Kent, Jr. | 200/83 N |
| 2,929,892 | 3/1960 | Blomgren | 200/82 R |
| 2,931,874 | 4/1960 | Leaman | 200/82 R X |
| 3,248,504 | 4/1966 | McGirr et al. | 337/416 X |
| 3,659,527 | 5/1972 | Abegg et al. | 102/28 EB |
| 3,698,323 | 10/1972 | Apstein | 200/83 R X |
| 3,793,501 | 2/1974 | Stonestrom | 200/61.08 |
| 3,803,374 | 4/1974 | Delgendre et al. | 200/61.08 |
| 3,991,649 | 11/1976 | Patrichi | 60/636 |

*Primary Examiner*—James R. Scott
*Attorney, Agent, or Firm*—Lynn H. Latta

[57] ABSTRACT

A piston, backed by a resilient disc, both slidable within a cylindrical case, is provided, on its leading end, with a penetrable conductor pellet, sheathed within an insulator cap. Upon firing of an explosive charge of disc form, arranged behind the piston with a polyethylene disc interposed between the charge and the piston, the latter will be driven forwardly against a pair of piercing points on the ends of a pair of conductor wires mounted in an insulator header in the leading end of the case, the driving force of the explosion being sufficient to cause the conductor wire points to pierce entirely through the insulator cap and to become embedded in the conductor pellet, thus closing a circuit across the conductor wires. A fusible bridge wire, embedded in the explosive charge, is fused by application of an electric current to a pair of conductors extending through an insulator header in the rear end of the case, the forward ends of these conductors being embedded in the explosive charge, and the fusible bridge wire being attached to these forward ends within the explosive charge, in bridging relation to the ends of these conductors.

6 Claims, 3 Drawing Figures

MINIATURE PYROTECHNIC SQUIB SWITCH, SINGLE POLE, NORMALLY OPEN

BACKGROUND OF INVENTION

In the patented art, the U.S. Pat. No. 3,111,808 to Fritz discloses a single-stroke actuator in which a piston is driven by detonation of an explosive charge, from a retracted position to a projected position in which it is held against return movement by penetration of a sharp edge at the trailing end of the piston into the cylinder wall under the reactive load (e.g. air pressure) tending to thrust the piston back into the cylinder. An actuator or propelling device having an explosive charge-propelled piston is also disclosed in Barr U.S. Pat. No. 3,119,302. Other patents disclosing devices powered by explosive charges are: Gross U.S. Pat. No. 2,742,697; Stupian U.S. Pat. No. 2,897,799; Bohl U.S. Pat. No. 2,924,147; and Stott U.S. Pat. No. 2,942,818.

RESUME OF THE INVENTION

This invention provides a miniature actuator (of which the case may be as small as ½ inch in length and ⅛ inch in diameter). It is of single-stroke requirement, powered by detonation of an explosive charge. It is normally open switch, closing an operative circuit when detonated.

The miniature size and weight of the switch make it especially suitable for single-stroke actuation of stage operations in the flight of a missile or outer space vehicle, and its relative simplicity of construction makes it ideally suitable for operation with minor possibility of failure. Its detonative action provides for split-second timing in stage actuation of the various functions of such a vehicle.

The provision of an actuator having such capabilities is the general object of the invention. Other objects will be apparent in the ensuing specifications, in which:

DETAILED DESCRIPTION OF THE INVENTION

OBJECT OF THE INVENTION

Figures 1, 2, 3:
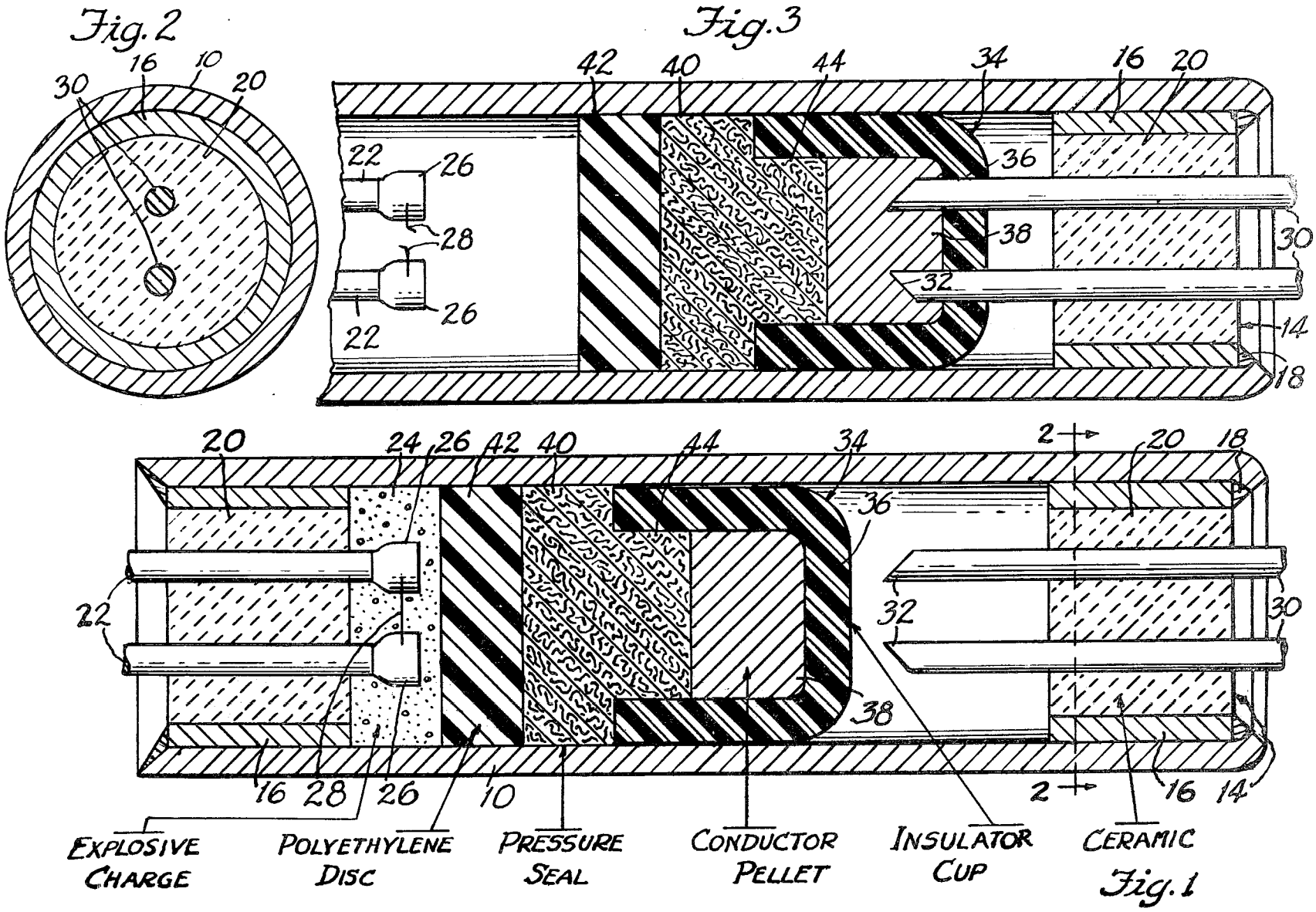
FIG. 1 is an axial sectional view of a switch embodying the invention, on a scale enlarged many times.
FIG. 2 is a cross-sectional view thereof, taken on the line 2—2 of FIG. 1.
FIG. 3 is a cross-sectional view of the switch after firing thereof.

Referring now to the drawing in detail, all operative parts of the device shown therein as an example of one form in which the invention may be embodied, are enclosed within a cylindrical shell 10 closed at its rear end by a header 12 and at its forward end by a header 14. Each of these headers is composed of a cylindrical ring 16 fitted snugly into a respective end of the shell, sealed thereto by a solder ring 18, and enclosing a cylindrical core 20 of ceramic material. At the rear end of the switch, a pair of lead wires 22 extend through the core 20 of header 12 and into a flat pancake charge of explosive material 24, and are flattened at their ends, as at 26, for secure attachment thereto of a fusible bridge wire 28. At the forward end of the switch, a pair of open-circuit wires 30 extend through the core 20 of header 14 and terminate in penetrative points 32 adapted, upon forward propulsion of the piston and conductor-pellet assembly 34, to penetrate through an insulator cup 36 on the forward end of assembly 34, and into a conductor pellet 38 enclosed within the cup 36, thus establishing an electrical circuit through pellet 36, across the wires 30.

Pellet assembly 34 further includes a piston unit including a head 40 having a flat rearward face and a cylindrical periphery, head 40 being of resilient, compressible material such as to be expanded into pressure-sealing contact with the internal wall of cylinder 10 when subjected to pressure by a disc 42 of polyethylene material, of flat pancake form, with a cylindrical periphery fitted to the internal wall of cylinder 10, and having opposed flat faces in contact respectively with the flat rear face of piston unit 40 and with the flat forward face of explosive charge 24. Piston unit 40 further includes an integral forward plug portion 44 which is snugly fitted into the rearward portion of insulator cup 36, thus holding the pellet assembly 34 and piston unit 40 in assembly. Explosive charge 24 is of flat, pancake form, filling the space between the opposed, parallel flat faces of header 12 and disc 42 within cylinder 10.

Bridge wire 28 has its respective end portions secured, by welding, to the flattened ends of lead wires 22.

The drawing discloses the switch in greatly magnified scale. The length of case 10 may actually be as little as ½ inch, and its diameter only ⅛ inch.

OPERATION

Upon application of electric current to the leads 22 at the rear end of the switch, the bridge wire 28 will be heated to a temperature such as to ignite the powder charge 24. The resulting gases of combustion will drive polyethylene disc 42, piston 44, conductor pellet 38 and insulator cup 36 forwardly with sufficient force to drive the points 32 of wires 30 through the bottom of the insulator cup 36 and to embed points 32 in the conductor pellet 38, thus completing the circuit through conductor wires 30.

In the commercial embodiment of the invention, the flattened ends 26 of leadwires 22 have eliminated one cause of occasional previous failures. Another feature to eliminate occasional rupture of case 10, was to lower the powder charge from 4.0 mg to 2.0 mg. Still another feature of the invention is the addition of polyethylene disc 42, improving the sealing in front of the powder charge.

I claim:

1. A pyrotechnic squib-switch comprising:

a tubular case;

a header closing the rear end of said case;

a pair of lead wires extending through and sealed in said header;

a fusible bridge wire attached to and bridging between the inner ends of said lead wires;

a disc of plastic material having a cylindrical periphery fitted to the internal wall of said case, said disc being spaced forwardly of said header to provide a space in which said wire ends and bridge wire are disposed;

an explosive charge in which said wire ends and bridge wire are embedded, said charge filling said space;

a piston assembly including a cup of electrical insulating material and a conductor pellet enclosed therein;

a header closing the forward end of said case;

and a pair of open-circuit wires extending through said forward end header and having, at their inward ends, penetrating points pointed toward said cup of insulating material and adapted, upon forward propulsion of the piston and conductor-pellet assembly by firing of said explosive charge in response to fusing of said bridge wire by application of an electric current to said lead wires, to penetrate through the bottom of said cup of insulating material and into said conductor pellet;

whereby a circuit through said open-circuit wires is closed.

2. A squib-switch as defined in claim 1, wherein the inner ends of said lead wires are flattened and the ends of said bridge wire are attached to the flattened faces thereof.

3. A squib switch as defined in claim 1, wherein said explosive charge is of the order of 2.0 mg. in weight and said case is of the order of ½ inch in length and ⅛ inch in diameter.

4. A pyrotechnic squib-switch comprising:

a tubular case;

a header closing the rear end of said case;

a pair of lead wires extending through and sealed in said header;

a fusible bridge wire attached to and bridging between inner ends of said lead wires, said inner ends being flattened where said bridge wire ends are attached thereto;

an explosive charge in which said wire ends and bridge wire are embedded, said charge being disposed in contact with the forward face of said header;

a piston assembly including a cup of electrical insulating material and a conductor pellet enclosed therein, a header closing the forward end of said case;

and a pair of open-circuit wires extending through said forward end header and having, at their inward ends, penetrating points pointed toward said cup of insulating material and adapted, upon forward propulsion of the piston and conductor-pellet assembly by firing of said explosive charge in response to fusing of said bridge wire by application of an electric current to said lead wires, to penetrate through the bottom of said cup and into said conductor pellet.

5. A squib-switch as defined in claim 4, wherein said piston assembly includes a head having a cylindrical periphery fitted to the internal wall of said cylinder, and a plug portion projecting into said cup and fitted to the internal wall thereof, said conductor pellet being confined between the end of said plug and the bottom of said cup.

6. A squib switch as defined in claim 5, wherein said piston head is of compressible material such as to be expanded into sealing engagement with said internal wall by the compressive action of said firing.

* * * * *